United States Patent [19]

Ota et al.

[11] 4,268,462

[45] May 19, 1981

[54] VARIABLE VENTURI CARBURETOR

[75] Inventors: Tadaki Ota; Katsushi Yoshikawa, both of Yokohama; Masaaki Saito, Yokosuka, all of Japan

[73] Assignee: Nissan Motor Company, Limited, Yokohama, Japan

[21] Appl. No.: 110,440

[22] Filed: Jan. 8, 1980

[30] Foreign Application Priority Data

Jan. 18, 1979 [JP] Japan ..... 54-4904[U]

[51] Int. Cl.[3] ..... F02M 7/22

[52] U.S. Cl. ..... 261/40; 123/439; 261/44 E; 261/50 A; 261/DIG. 56; 261/DIG. 74

[58] Field of Search ..... 261/40, 50 A, DIG. 74, 261/44 E, DIG. 56; 123/439

[56] References Cited

U.S. PATENT DOCUMENTS

| | | | |
|---|---|---|---|
| 2,877,003 | 3/1959 | Goodridge et al. | 261/62 |
| 3,704,867 | 12/1972 | Diehl | 261/DIG. 56 |
| 4,132,203 | 1/1979 | Elpern et al. | 261/DIG. 74 |
| 4,172,436 | 10/1979 | Mennesson | 261/DIG. 74 |
| 4,187,805 | 2/1980 | Abbey | 123/439 |

FOREIGN PATENT DOCUMENTS

| | | | |
|---|---|---|---|
| 2553427 | 1/1976 | Fed. Rep. of Germany | 261/50 A |

*Primary Examiner*—Tim R. Miles

*Attorney, Agent, or Firm*—James C. Wray

[57] ABSTRACT

A variable venturi carburetor is disclosed which includes a mixture conduit having therein a throttle plate, a fixed venturi, and a vacuum sustaining plate for variably opening and closing the throat of the fixed venturi. A first fuel nozzle opens into the mixture conduit at a point on the downstream side of the vacuum sustaining plate. An electromagnetic valve is provided for controlling the amount of fuel drawn from the auxiliary fuel nozzle so that it can vary in accordance with the degree of opening of the vacuum sustaining plate but is held at a level when the degree of opening of the vacuum sustaining plate is over a predetermined level. A second fuel nozzle is provided which opens into the mixture conduit at a point on the upstream of the vacuum sustaining plate for allowing discharge of fuel in amounts proportional to vacuums appearing in the mixture conduit upstream of the vacuum sustaining plate.

4 Claims, 1 Drawing Figure

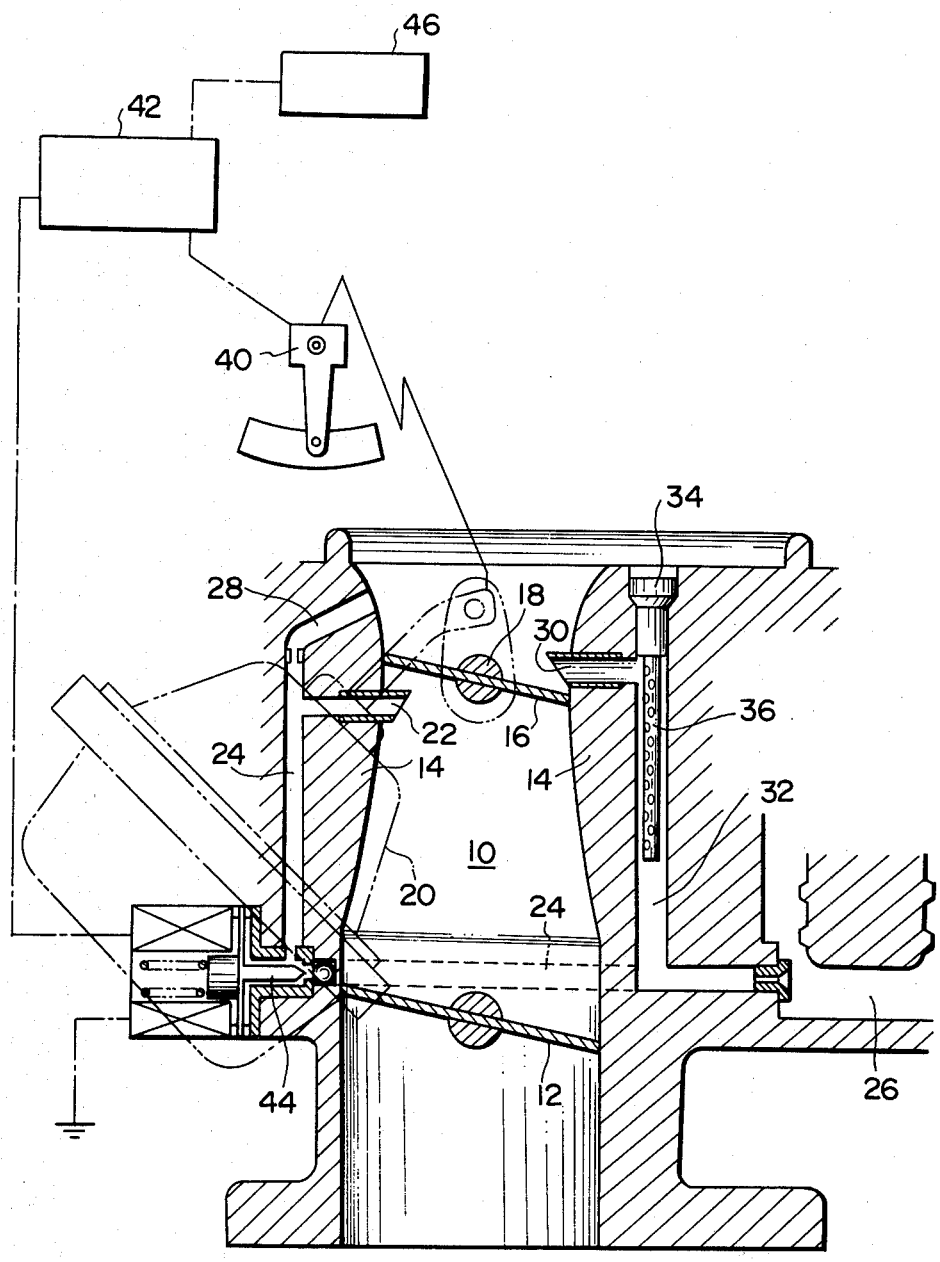
46
42
40
34
28
18
30
36
22
16
24
14
14
32
10
20
24
44
12
26

VARIABLE VENTURI CARBURETOR

BACKGROUND OF THE INVENTION

1. Field of the Invention

This invention relates to a carburetor for use with an internal combustion engine and, more particularly, to a variable venturi carburetor having a variable venturi for variably determining the opening of a venturi throat defined thereby.

2. Description of the Prior Art

Normal variable venturi carburetors include a through passage-way mixture conduit with oppositely disposed inlet and outlet ends. The mixture conduit has a variable venturi for variably determining the opening of a venturi throat defined thereby, and a throttle plate located within the outlet end of the mixture conduit for opening and closing the mixture conduit and thereby metering the amount of mixture that exits from the mixture conduit. A fuel nozzle opens into the mixture conduit at a point on the downstream side of the variable venturi and connected to a fuel reservoir for providing fuel in amounts dependent on vacuum appearing and the mixture conduit between the variable venturi and the throttle valve. A jet needle is inserted into the fuel nozzle and drivingly associated with the variable venturi for controlling the amount of fuel drawn from the fuel nozzle so as to maintain the ratio of the airfuel mixture constant.

Another type of variable venturi carburetors are also well known in which the jet needle is removed and instead an electromagnetic valve is provided in the fuel condiut leading to the fuel nozzle for opening and closing the fuel conduit so as to control the amount of fuel discharged from the fuel nozzle. The variable venturi carburetors of this type further include a sensor for detecting the opening of the venturi throat and a control circuit associated with the opening sensor for providing a drive pulse signal with a duty factor corresponding to the opening of the venturi throat to the electromagnetic valve to control the amount of fuel flowing through the electromagnetic valve.

Although the latter variable venturi carburetors boast several advantages over the former variable venturi carburetors in that their control accuracy is subject to less variation with time and their size is relatively small, they present other difficulties. First, they require a large electromagnetic valve capable of passing a large volume of fuel so as to control the inlet air-fuel ratio over the full range of operation of the engine. Second, high techniques are required to control the operation of the electromagnetic valve with a drive pulse signal having its duty factor varying in a wide range. Third, a high accurate sensor is required which can detect the amount of air flowing through the variable venturi with high accuracy. These difficulties stem mainly from the arrangement in which the electromagnetic valve is used to control the amount of fuel drawn from the fuel nozzle over the full range of operation of engine.

SUMMARY OF THE INVENTION

It is therefore one object of the present invention to provide an improved variable venturi carburetor which can eliminate the need for any high accurate sensor and large capacity electromagnetic valve.

Another object of the present invention is to provide an improved variable venturi carburetor which will be high in control accuracy, reliability and durability and low in manufacturing cost.

According to the present invention, this and other objects are accomplished by a variable venturi carburetor which comprises a fuel reservoir, a through passage-way mixture conduit, a throttle plate swingably disposed for opening and closing the outlet end of the mixture conduit and thereby metering the amount of mixture that exits from the mixture conduit, the mixture conduit formed with a fixed venturi upstream of the throttle plate, a vacuum sustaining plate swingably disposed for opening and closing the throat of the fixed venturi for controlling admission of air and for generating venturi effects in the mixture conduit that are variable with the swingable positions of the vacuum sustaining plate, a first fuel nozzle opening into the mixture conduit at a point on one side of the fixed venturi and on the downstream side of the vacuum sustaining plate, the first fuel nozzle connected through a fuel conduit to the fuel reservoir, an opening sensor associated with the vacuum sustaining plate for sensing the opening of the throat of the fixed venturi, a control circuit associated with the opening sensor for providing a drive pulse signal with its duty factor varying in accordance with the degree of opening of the vacuum sustaining plate but held at a level when the degree of opening of the vacuum sustaining plate is over a predetermined level, an electromagnetic valve provided for opening and closing the fuel conduit so as to control the amount of fuel drawn from the first fuel nozzle in response to the drive pulse signal applied thereto from the control circuit, a second fuel nozzle connected to the reservoir and opening into the mixture conduit at a point on the opposite side of the fixed venturi and on the upstream side of the vacuum sustaining plate.

Other objects, means and advantages of the present invention will become apparent to one skilled in the art thereof from the following description.

BRIEF DESCRIPTION OF THE DRAWING

The single FIGURE is a longitudinal sectional view showing one embodiment of a variable venturi carburetor made in accordance with the present invention.

DESCRIPTION OF THE PREFERRED EMBODIMENT

Referring now to FIG. 1, the variable venturi carburetor of the present invention comprises a through passage-way mixture conduit 10 with oppositely disposed inlet and outlet ends. The mixture conduit 10 has a throttle plate 12 swingably disposed within the outlet end of the mixture conduit 10 and thereby metering the amount of mixture that exits from the mixture conduit 10. The mixture conduit 10 has also a fixed venturi 14 upstream of the throttle valve 12, and a vacuum sustaining plate 16 swingably disposed on an axis 18 for varying the opening of the throat of the fixed venturi 14 so as to control admission of air and to generate venturi effects in the mixture conduit that are variable with the swingable positions of the vacuum sustaining plate 16. A diaphragm unit 20 is provided which is drivingly associated with the vacuum sustaining plate 16 for controlling the opening of the venturi throat in accordance with vacuum appearing in the mixture conduit 10 between the vacuum sustaining plate 16 and the throttle plate 12 so as to maintain the vacuum constant.

Opening into the mixture conduit at a point on one side of the fixed venturi 14 and on the downstream side of the vacuum sustaining plate 16 is an auxiliary fuel nozzle 22 which is connected through an auxiliary fuel conduit 24 to a float chamber 26 charged with fuel through a fuel pump (not shown). The auxiliary fuel nozzle 22 is also connected through an air bleed 28 to the inlet end of the mixture conduit 10 upstream of the vacuum sustaining plate 16. the air bleed 28 introduces air and mixes it with fuel to be discharged from the auxiliary fuel nozzle 22 for high fuel atomization.

Opening into the mixture conduit 10 at a point on the opposite side of the fixed venturi 14 and on the upstream side of the vacuum sustaining plate 16 is a main fuel nozzle 30 which is connected through a main fuel conduit 32 to the float chamber 26 and also through an air bleed 34 to atmospheric air. An emulsion tube 36 is inserted to extend downward from the bottom of the air bleed 34 into the main fuel conduit 32 for high fuel atomization.

The variable venturi carburetor further comprises a control unit for controlling the amount of fuel discharged from the auxiliary fuel nozzle 22 so as to maintain the inlet air-fuel ratio at an optimum level. The control unit includes an opening sensor 40 which may be taken in the form of a variable resistance type potentiometer drivingly associated with the axis 18 of the vacuum sustaining plate 16 for converting the angle of rotation of the vacuum sustaining plate 16 into a voltage signal. The control unit also comprises a control circuit 42 which is responsive to the signal from the opening sensor 40 for generating at its output an on-off type of drive pulse signal having a duty factor corresponding to the opening of the vacuum sustaining plate 16. An electromagnetic valve 44 is provided in the auxiliary fuel conduit 24 for opening and closing the same so as to control the amount of fuel drawn from the auxiliary fuel nozzle 22 into the mixture conduit 10 in response to the drive pulse signal applied thereto from the control circuit 42. The control circuit 42 is adapted to provide a drive pulse signal having its duty factor held constant under high load conditions when the opening of the vacuum sustaining plate 16 is such as to permit introduction of a great amount of air into the mixture conduit 10.

Under high load conditions, the degree of opening of the vacuum sustaining plate 16 is large. When the degree of opening of the vacuum sustaining plate 16 increases above a predetermined level, the duty factor of the drive pulse signal fed from the control circuit 42 to the electromagnetic valve 44 is held at a predetermined level. As the degree of opening of the vacuum sustaining plate 16 increases, the amount of air flowing through the annular gap defined between the fixed venturi 14 and the vacuum sustaining plate 16 increases to produce an increased venturi vacuum so as to drawn an increased amount of fuel from the main fuel nozzle 30 into the mixture conduit 10 thereby compensating for the lack of the amount of fuel discharged from the auxiliary fuel nozzle 22 so as to hold the inlet air-fuel ratio at a predetermined level.

Since the electromagnetic valve 44 is controlled within a relatively narrow range of operation of the engine; i.e., under low and intermediate load conditions, the range of variation of the duty factor of the valve driving pulse signal can be decreased to about the 50% of that required in conventional carburetors where the electromagnetic valve is controlled in the full range of operation of the engine. This permits correction of the duty factor of the valve driving pulse signal so as to provide an optimum air-fuel ratio in accordance with various engine operating conditions. For this purpose, the control circuit 42 may have inputs from various sensors 46 such as a water temperature sensor, height sensor, acceleration sensor, λ-control sensor, and the like for correcting the duty factor of the valve driving pulse signal in accordance with such various engine operating conditions.

A highly important feature of the present invention resides in a variable venturi carburetor which comprises a mixture conduit having therein a throttle plate, a fixed venturi and a vacuum sustaining plate for variably opening and closing the throat of the fixed venturi, an auxiliary fuel nozzle opening into the mixture conduit at a point on the downstream side of the vacuum sustaining plate, an electromagnetic valve for controlling the amount of fuel drawn from the auxiliary fuel nozzle so that it can vary in accordance with the degree of opening of the vacuum sustaining plate but is held at a level when the degree of opening of the vacuum sustaining plate is over a predetermined level, and a main fuel nozzle opening into the mixture conduit at a point on the upstream side of the vacuum sustaining plate for allowing discharge of fuel in amounts proportional to vacuums appearing in the mixture conduit upstream of the vacuum sustaining plate so as to compensate for the lack of fuel discharged from the auxiliary fuel nozzle under high load conditions. Thus, it is possible to eliminate the need for any large capacity electromagnetic valve and for any sensor capable of sensing the amount of air flowing through the vacuum sustaining plate with great accuracy over a wide range of operation of the engine. This results in a reliable, durable, small, light and inexpensive variable venturi carburetor. Additionally, since the range where the electromagnetic valve controls the amount of fuel discharged from the auxiliary fuel nozzle is narrower as compared with conventional carburetors, it is easy to correct the amount of fuel discharged from the auxiliary fuel nozzle in accordance with various engine operating conditions.

It is to be noted that the electromagnetic valve may be of the type operable in on-off fashion or analog fashion in accordance with the duty factor of the drive pulse signal fed thereto from the control circuit.

What is claimed is:

1. A variable venturi carburetor comprising a fuel reservoir, a through passage-way mixture conduit (10), a throttle plate (12) swingably disposed for opening and closing the outlet end of said mixture conduit (10) and thereby metering the amount of mixture that exits from said mixture conduit (10), said mixture conduit (10) formed with a fixed venturi (14) upstream of said throttle plate (12), a vacuum sustaining plate (16) swingably disposed for opening and closing the throat of said fixed venturi (14) for controlling admission of air and for generating venturi effects in said mixture conduit (10) that are variable with the swingable positions of said vacuum sustaining plate (16), a first fuel nozzle (22) opening into said mixture conduit (10) at a point on one side of said fixed venturi (14) and on the downstream side of said vacuum sustaining plate (16), said first fuel nozzle connected through a fuel conduit (24) to said fuel reservoir, an opening sensor (40) associated with said vacuum sustaining plate (16) for sensing the opening of the throat of said fixed venturi (14), a control circuit (42) associated with said opening sensor for providing a drive pulse signal with its duty factor varying in accordance with the degree of opening of said vacuum sustaining plate (16) but held at a level when the degree of opening of said vacuum sustaining plate (16) is over a predetermined level, an electromagnetic valve (44) provided for opening and closing said fuel conduit (24) so as to control the amount of fuel drawn from said first fuel nozzle (22) in response to the drive pulse signal applied thereto from said control circuit (42), a second fuel nozzle (30) connected to said reservoir and opening into said mixture conduit (10) at a point on the opposite side of said fixed venturi (14) and on the upstream side of said vacuum sustaining plate (16).

2. A variable venturi carburetor according to claim 1, which further comprises variable sensors (50) for sensing various engine operating conditions and thereby correcting the duty factor of the drive pulse signal in accordance with such engine operating conditions.

3. A variable venturi carburetor according to claim 1, wherein said electromagnetic valve (44) is operable in analog form in response to the drive pulse signal applied thereto from said control circuit.

4. A variable venturi carburetor according to claim 1, wherein said electromagnetic valve (44) is operable in on-off form in response to the drive pulse signal applied thereto from said control circuit.

* * * * *